US012781325B2

(12) United States Patent
Schwarzenbrunner et al.

(10) Patent No.: US 12,781,325 B2
(45) Date of Patent: Nov. 3, 2026

(54) HIGH STRENGTH COLD ROLLED STEEL SHEET FOR AUTOMOTIVE USE HAVING EXCELLENT GLOBAL FORMABILITY AND BENDING PROPERTY

(71) Applicants: VOESTALPINE STAHL GMBH, Linz (AT); TOYOTA MOTOR EUROPE NV/SA, Brussels (BE)

(72) Inventors: Michael Schwarzenbrunner, Walding (AT); Edip Ozer Arman, Zaventem (BE); Thomas Hebesberger, Pasching (AT)

(73) Assignees: VOESTALPINE STAHL GMBH, Linz (AT); TOYOTA MOTOR EUROPE NV/SA, Brussels (BE)

( * ) Notice: Subject to any disclaimer, the term of this patent is extended or adjusted under 35 U.S.C. 154(b) by 372 days.

(21) Appl. No.: 18/283,961

(22) PCT Filed: Apr. 5, 2022

(86) PCT No.: PCT/EP2022/059016
§ 371 (c)(1),
(2) Date: Sep. 25, 2023

(87) PCT Pub. No.: WO2022/214488
PCT Pub. Date: Oct. 13, 2022

(65) Prior Publication Data

US 2024/0167137 A1 May 23, 2024

(30) Foreign Application Priority Data

Apr. 7, 2021 (SE) ..... 21504311

(51) Int. Cl.
*C22C 38/38* (2006.01)
*C21D 6/00* (2006.01)
(Continued)

(52) U.S. Cl.
CPC ..... *C22C 38/38* (2013.01); *C21D 6/002* (2013.01); *C21D 6/005* (2013.01); *C21D 8/02* (2013.01);
(Continued)

(58) Field of Classification Search
CPC ..... C22C 38/38; C22C 38/02; C22C 38/06; C22C 38/58; C22C 38/42; C22C 38/44;
(Continued)

(56) References Cited

U.S. PATENT DOCUMENTS 10,106,874 B2 * 10/2018 Paul ..... C22C 38/06
10,202,664 B2 * 2/2019 Krizan ..... C21D 1/78
(Continued)

FOREIGN PATENT DOCUMENTS

CN 104204261 A 12/2014
CN 104245971 A 12/2014
(Continued)

OTHER PUBLICATIONS

International Search Report and Written Opinion Dated Jul. 13, 2022, for International Patent Application No. PCT/EP2022/059016.
(Continued)

*Primary Examiner* — John A Hevey
(74) *Attorney, Agent, or Firm* — KARCESKI IP LAW, PLLC

(57) ABSTRACT

A high strength cold rolled steel sheet has a composition consisting of the following elements (in wt. %): C 0.08-0.14, Mn 2.5-3.0, Si 0.7-1.1, Cr 0.05-0.4, optionally Al≤0.2, Nb≤0.1, Mo≤0.1, V≤0.1, Ti≤0.1, Ca≤0.05, Cu≤0.1, Ni≤0.2, B≤0.005, balance Fe apart from impurities. The steel has a yield ratio ≤0.72 and a bendability (Ri/t) is ≤2.0. A method of manufacturing the steel sheet and an automotive structural part comprising the steel sheet also is provided.

12 Claims, 1 Drawing Sheet

(51) Int. Cl.

| | |
|---|---|
| ***C21D 8/02*** | (2026.01) |
| ***C21D 8/0221*** | (2026.01) |
| ***C21D 8/0247*** | (2026.01) |
| ***C22C 38/02*** | (2006.01) |

(52) U.S. Cl.
CPC ..... *C21D 8/0226* (2013.01); *C21D 8/0236* (2013.01); *C21D 8/0263* (2013.01); *C21D 8/0273* (2013.01); *C22C 38/02* (2013.01); *C21D 2211/001* (2013.01); *C21D 2211/005* (2013.01); *C21D 2211/008* (2013.01)

(58) Field of Classification Search
CPC ..... C22C 38/46; C22C 38/48; C22C 38/50; C22C 38/54; C21D 6/002; C21D 6/005; C21D 8/02; C21D 8/0226; C21D 8/0236; C21D 8/0263; C21D 8/0273; C21D 2211/001; C21D 2211/005; C21D 2211/008; C21D 1/18; C21D 6/008; C21D 8/0247; C21D 9/46
See application file for complete search history.

(56) References Cited

U.S. PATENT DOCUMENTS

| | | | | |
|---|---|---|---|---|
| 10,227,683 | B2 * | 3/2019 | Hebesberger | C22C 38/46 |
| 2019/0352750 | A1 * | 11/2019 | Hebesberger | C22C 38/02 |
| 2020/0347473 | A1 * | 11/2020 | Kohsaka | C22C 38/32 |

FOREIGN PATENT DOCUMENTS

| | | | |
|---|---|---|---|
| CN | 108884536 | A | 11/2018 |
| CN | 109642280 | A | 4/2019 |
| CN | 110268085 | A | 9/2019 |
| EP | 2831296 | A1 | 2/2015 |
| EP | 3754035 | A1 | 12/2020 |
| JP | 2010126808 | A | 6/2010 |
| JP | 2010229514 | A | 10/2010 |
| JP | 2012229466 | A | 11/2012 |
| JP | 2013227654 | A | 11/2013 |
| JP | 2015516510 | A | 6/2015 |
| JP | 2015516511 | A | 6/2015 |
| JP | 2020509162 | A | 3/2020 |
| KR | 20160001485 | A | 1/2016 |
| WO | 2018009090 | A1 | 1/2018 |
| WO | 2018096090 | A1 | 5/2018 |
| WO | 2019181950 | A1 | 9/2019 |
| WO | 2020151855 | A1 | 7/2020 |

OTHER PUBLICATIONS

Chinese Office Action dated Dec. 27, 2025, for Chinese Patent Application No. 202280026011.X.
Japanese Office Action dated Jun. 2, 2026, Japanese Patent Application No. 2023-561357.

* cited by examiner

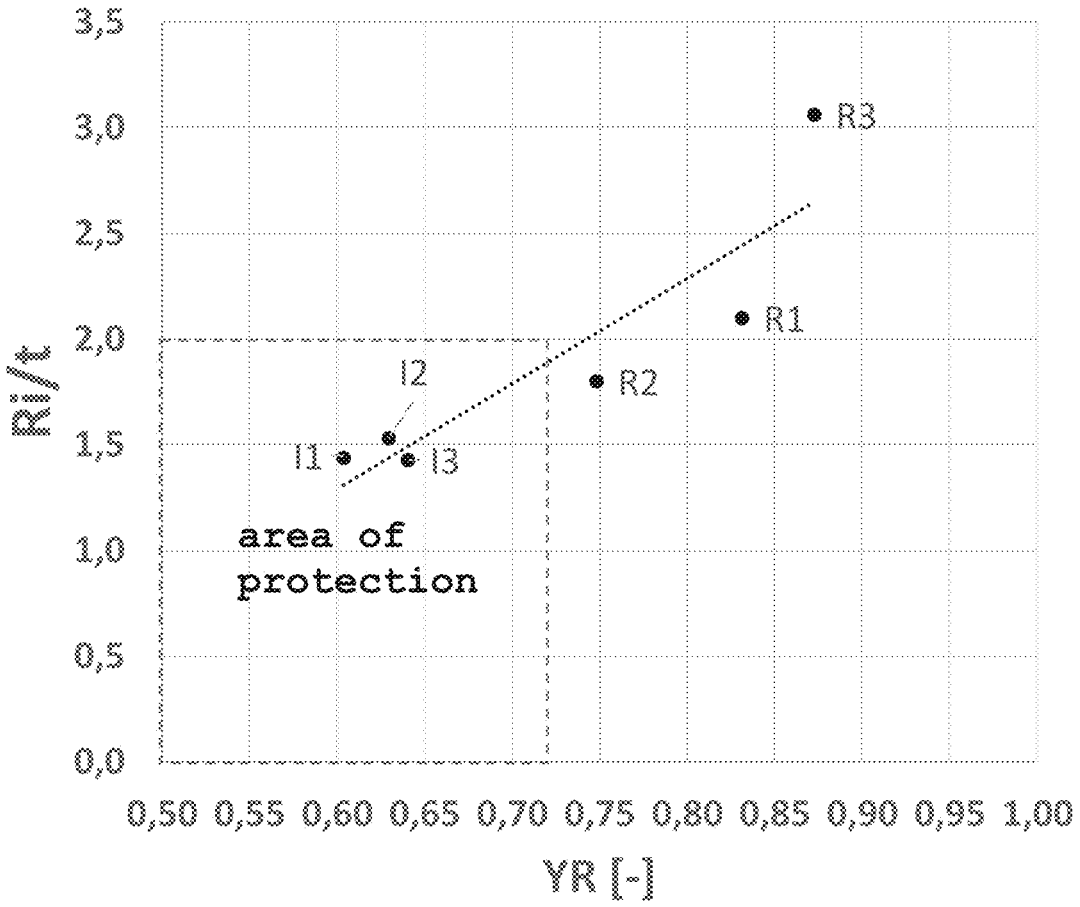
3,5
3,0
2,5
2,0
1,5
1,0
0,5
0,0
Ri/t
R3
R1
R2
I2
I1
I3
area of
protection
0,50 0,55 0,60 0,65 0,70 0,75 0,80 0,85 0,90 0,95 1,00
YR [-]

HIGH STRENGTH COLD ROLLED STEEL SHEET FOR AUTOMOTIVE USE HAVING EXCELLENT GLOBAL FORMABILITY AND BENDING PROPERTY

CROSS-REFERENCE TO RELATED APPLICATION(S)

This is a National Stage Entry into the United States Patent and Trademark Office from International Patent Application No. PCT/EP2022/059016, filed on Apr. 5, 2022, which relies on and claims priority to Swedish Patent Application No. 21504311, filed on Apr. 7, 2021, the entire contents of both of which are incorporated herein by reference.

FIELD OF THE INVENTION

The present invention relates to high strength steel sheets suitable for applications in automobiles. In particular, the invention relates to cold rolled steel sheets having a tensile strength of at least 980 MPa and having excellent global formability and excellent bending property.

BACKGROUND OF THE INVENTION

For a great variety of applications increased strength levels are a pre-requisite for light-weight constructions in particular in the automotive industry, since car body mass reduction results in reduced fuel consumption.

Automotive body parts are often stamped out of sheet steels, forming complex structural members of thin sheet. However, such parts cannot be produced from conventional high strength steels, because of a too low formability for complex structural parts. For this reason, multiphase Transformation Induced Plasticity aided steels (TRIP steels) have gained considerable interest in the last years, in particular for use in auto body structural parts.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect acts to resist necking in the material and postpone failure in sheet forming operations. The microstructure of a TRIP steel can greatly alter its mechanical properties.

WO2018/09090 A1 discloses a high strength TBF steel with a high yield ratio (local formability) with excellent resistance to edge cracking and a high hole expansion ratio.

Although these steels disclose several attractive properties there is demand for 980 MPa steel sheets having an improved property profile with respect global formability and bending properties. Particularly, the B-pillar hinge, roof rail, door panel or similar parts of an automobile would have use of such material.

SUMMARY OF THE INVENTION

The present invention is directed to high strength (TBF) steel sheets having a tensile strength of 980-1180 MPa and an excellent global formability and excellent bending properties. It should further be possible to produce the steel sheets on an industrial scale in a Continuous Annealing Line (CAL). The invention aims at providing a steel composition that can be processed to complicated structural members, where both yield ratio, which affect the global formability, and bendability is of importance. It is particularly suitable for a B-pillar hinge, roof rail, door panel or similar parts in an automobile.

BRIEF DESCRIPTION OF THE DRAWINGS

The sole FIGURE appended hereto is a diagram where the bendability Ri/t is plotted against the yield ratio.

DETAILED DESCRIPTION OF EMBODIMENT(S) OF THE INVENTION

The invention is described in the paragraphs that follow.

The steel sheet has a composition consisting of the following alloying elements (in wt. %):

| | |
|---|---|
| C | 0.08-0.14 |
| Mn | 2.5-3.0 |
| Si | 0.7-1.1 |
| Cr | 0.05-0.4 |
| Optionally | |
| Al | ≤0.2 |
| Nb | ≤0.1 |
| Mo | ≤0.1 |
| V | ≤0.1 |
| Ti | ≤0.1 |
| Ca | ≤0.05 |
| Cu | ≤0.1 |
| Ni | ≤0.2 |
| B | ≤0.005 |

the balance consists of iron and impurities.

The importance of the separate elements and their interaction with each other as well as the limitations of the chemical ingredients of the claimed alloy are briefly explained in the following. All percentages for the chemical composition of the steel are given in weight % (wt. %) throughout the description. The amount of hard phases is given in volume % (vol. %). Upper and lower limits of the individual elements can be freely combined within the limits set out in the claims. The arithmetic precision of the numerical values can be increased by one or two digits for all values given in the present application. Hence, a value of given as e.g. 0.1% can also be expressed as 0.10 or 0.100%.

C: 0.08-0.14%

C stabilizes the austenite and is important for obtaining sufficient carbon within the retained austenite phase. C is also important for obtaining the desired strength level. Generally, an increase of the tensile strength in the order of 100 MPa per 0.1% C can be expected. When C is lower than 0.08% then it is difficult to attain a tensile strength of 980 MPa. If C exceeds 0.14%, then the weldability is impaired. The upper limit may be 0.13 or 0.12%. The lower limit may be 0.09, or 0.10%. A preferred range is 0.09-0.12%.

Preferably, the carbon equivalent $CE_L$ (=C+Si/50+Mn/25+P/2+Cr/25) should be with in the range of 0.20-0.30.

Mn: 2.5-3.0%

Manganese is a solid solution strengthening element, which stabilises the austenite by lowering the $M_s$ temperature and prevents ferrite and pearlite to be formed during cooling. In addition, Mn lowers the $A_{c3}$ temperature and is important for the austenite stability. At a content of less than 2.5% it might be difficult to obtain the desired amount of retained austenite, a tensile strength of 980 MPa and the austenitizing temperature might be too high for conventional industrial annealing lines. In addition, at lower contents it may be difficult to avoid the formation of polygonal ferrite.

However, if the amount of Mn is higher than 3.0%, problems with segregation may occur because Mn accumulates in the liquid phase and causes banding resulting in a potentially deteriorated workability. The upper limit may therefore be 3.0, 2.9, 2.8 or 2.7%. The lower limit may be 2.5, or 2.6%.

Si: 0.7-1.1%

Si acts as a solid solution strengthening element and is important for securing the strength of the thin steel sheet. Si suppresses the cementite precipitation and is essential for austenite stabilization. However, if the content is too high, then to much silicon oxides will form on the strip surface, which may lead to cladding on the rolls in the CAL and surface defects on subsequently produced steel sheets. The upper limit is therefore 1.1% and may be restricted to 1.05, 1.0 or 0.95%. The lower limit may be 0.75 or 0.80%. A preferred range is 0.7-1.0%.

Cr: 0.05-0.4%

Cr is effective in increasing the strength of the steel sheet. Cr is an element that forms ferrite and retards the formation of pearlite and bainite. The $A_{c3}$ temperature and the $M_s$ temperature are only slightly lowered with increasing Cr content. Cr results in an increased amount of stabilized retained austenite. The amount of Cr is limited to 0.4%. The upper limit may be 0.35, 0.30 or 0.25%. The lower limit may be 0.10, or 0.15%. A preferred range is 0.1-0.3%.

Al: ≤0.2%

Al promotes ferrite formation and is also commonly used as a deoxidizer. The $M_s$ temperature is increased with an increasing Al content. A further drawback of Al is that it results in a drastic increase in the $A_{c3}$ temperature and therefore makes it more difficult to austenitize the steel in the CAL. For these reasons, the Al content is preferably limited to less than 0.2%, more preferably to less than 0.1%, most preferably less than 0.06%.

Nb: ≤0.1%

Nb is commonly used in low alloyed steels for improving strength and toughness, because of its influence on the grain size. Nb increases the strength elongation balance by refining the matrix microstructure and the retained austenite phase due to precipitation of NbC. The steel may contain Nb in an amount of ≤0.1%. A deliberate addition of Nb is not necessary according to the present invention. The upper limit may therefore be restricted to ≤0.03%. The upper limit may further be restricted to 0.01, or 0.005%.

Mo≤0.1%

Molybdenum can be added to improve strength. It may further enhance the benefits of NbC precipitates by reducing the carbide coarsening kinetics. A deliberate addition of Mo is not necessary according to the present invention. The upper limit may therefore be restricted to ≤0.03%. The upper limit may further be restricted to 0.02, or 0.01%.

V: ≤0.1%

The function of V is similar to that of Nb in that it contributes to precipitation hardening and grain refinement. The steel may contain V in an amount of ≤0.1%. The upper limit may be restricted to 0.09, 0.07, 0.05, 0.03, or 0.01%. A deliberate addition of V is not necessary according to the present invention. The upper limit may therefore be restricted to ≤0.01%.

Ti: ≤0.1%

Ti is commonly used in low alloyed steels for improving strength and toughness, because of its influence on the grain size by forming carbides, nitrides or carbonitrides. In particular, Ti is a strong nitride former and can be used to bind the nitrogen in the steel. However, the effect tends to be saturated above 0.1%. The upper limit may be restricted to 0.09, 0.07, 0.05, 0.03, or 0.01%. A deliberate addition of Ti is not necessary according to the present invention. The upper limit may therefore be restricted to ≤0.005%.

Ca≤0.05

Ca may be used for the modification of the non-metallic inclusions. The upper limit is 0.05% and may be set to 0.04, 0.03, 0.01%. A deliberate addition of Ca is not necessary according to the present invention. The upper limit may therefore be restricted to ≤0.004%.

Cu: ≤0.1%

Cu is an undesired impurity element that is restricted to ≤0.1% by careful selection of the scrap used. The upper limit may be restricted to ≤0.06%.

Ni: ≤0.2%

Ni is an undesired impurity element that is restricted to ≤0.2% by careful selection of the scrap used. The upper limit may be restricted to ≤0.08%.

B: ≤0.005%

B is an undesired impurity element that is restricted to ≤0.005% by careful selection of the scrap used. B increases hardness but may come at a cost of reduced bendability and is therefore not desirable in the present suggested steel. B may further make scrap recycling more difficult and an addition of B may also deteriorate workability. A deliberate addition of B is therefore not desired according to the present invention. The upper limit may therefore be restricted to ≤0.0006%.

Other impurity elements may be comprised in the steel in normal occurring amounts. However, it is preferred to limit the amounts of P, S, As, Zr, Sn to the following optional maximum contents:

P: ≤0.02%
S: ≤0.005%
As ≤0.010%
Zr ≤0.005%
Sn ≤0.015%

It is also preferred to control the nitrogen content to the range:

N: ≤0.015%, preferably 0.003-0.008%

In this range a stable fixation of the nitrogen can be achieved.

Oxygen and hydrogen can further be limited to

O: ≤0.0003
H: ≤0.0020

The high strength TRIP-assisted bainitic ferrite (TBF) steel sheets of the present invention have microstructure mainly consisting of retained austenite inclusions embedded in the matrix.

The microstructural constituents are in the following expressed in volume % (vol. %).

The steel comprises a matrix of bainitic ferrite (BF). Hence, the amount of bainitic ferrite is generally ≥50%. The microstructure may also contain tempered martensite (TM). The constituents BF and TM may be difficult to distinguish from each other. Therefore, the total content of both constituents may be limited to 70-90%. The amount is normally in the range of 75-85%.

Martensite may be present in the final microstructure because, depending on its stability, some austenite may transform to martensite during cooling at the end of the overaging step. Martensite may be present in an amount of ≤15%, preferably ≤10%. The amount is normally in the range of 5-10%. These un-tempered martensite particles are often in close contact with the retained austenite particles, and they are therefore often referred to as martensite-austenite (MA) particles.

Retained austenite is a prerequisite for obtaining the desired TRIP effect. The amount of retained austenite should therefore be in the range of 2-20%, preferably 5-15%. The amount of retained austenite was measured by means of the saturation magnetization method described in detail in Proc. Int. Conf. on TRIP-aided high strength ferrous alloys (2002), Ghent, Belgium, p. 61-64.

Polygonal ferrite (PF) is not a desired microstructural constituent and is therefore limited to ≤10%, preferably ≤5%, ≤3% or ≤1%. Most preferably, the steel is free from PF.

The mechanical properties of the claimed steel are important and at least one of the following requirements should be fulfilled:

| | |
|---|---|
| tensile strength ($R_m$) | 980-1180 MPa |
| yield strength ($R_{p0.2}$) | 580-750 MPa |
| total elongation ($A_{50}$) | ≥11% |
| yield ratio ($R_{p0.2}/R_m$) | ≤0.72 |
| bendability (Ri/t) | ≤2 |

Preferably, all these requirements are fulfilled at the same time.

The upper limit of the tensile strength ($R_m$) can further be limited to 1160, 1140, 1120, or 1100 MPa. The lower limit may further be limited to 990 or 1000 MPa.

The upper limit of the yield strength ($R_{p0.2}$) can further be limited to 740, 730, 720, 710, 700, 890, 680, 670, or 660 MPa. A preferred interval is 580-700 MPa.

The upper limit of the yield ratio ($R_{p0.2}/R_m$) can further be limited to 0.71, 0.70, 0.69, 0.68, 0.67, 0.66, or 0.65. The lower limit could be 0.50, 0.51, 0.52, 0.53, 0.54, 0.55, 0.56, 0.57 or 0.58.

The $R_m$, $R_{p0.2}$ values as well as the total elongation ($A_{50}$) are derived in accordance with the Japanese Industrial Standard JIS Z 2241: 2011, wherein the samples are taken in the transversal direction of the strip.

The upper limit of the bendability Ri/t may further be limited to 1.9, 1.8, 1.7, 1.6 or 1.5. Preferably Ri/t≤1.7, more preferably ≤1.5. The lower limit of Ri/t may be 0.5, 0.6, 0.7, 0.8, 0.9, or 1.0.

The bendability is evaluated by the ratio of the limiting bending radius (Ri), which is defined as the minimum bending radius with no occurrence of cracks, and the sheet thickness, (t). For this purpose, a 90° V-shaped block is used to bend the steel sheet in accordance with JIS Z2248. The sample size is 35×100 mm. The bending value Ri/t is obtained by dividing the limit bending radius in mm with the thickness in mm.

The mechanical properties of the steel sheets of the present invention can be largely adjusted by the alloying composition and the microstructure. The microstructure can be adjusted by the heat treatment in the CAL, in particular by the isothermal treatment temperature in the overaging step.

The suggested steel can be produced by making steel slabs of the conventional metallurgy by converter melting and secondary metallurgy with the composition suggested above. The slabs are hot rolled in austenitic range to a hot rolled strip. Preferably by reheating the slab to a temperature between 1000° C. and 1280° C., rolling the slab completely in the austenitic range wherein the hot rolling finishing temperature is greater than or equal to 850° C. to obtain the hot rolled steel strip. Thereafter the hot rolled strip is coiled at a coiling temperature in the range of 500-650° C. Optionally subjecting the coiled strip to a scale removal process, such as pickling. The coiled strip is thereafter batch annealed at a temperature in the range of 500-650° C., preferably 550-650° C., for a duration of 5-30 h. Thereafter cold rolling the annealed steel strip with a reduction rate between 35 and 90%, preferably around 40-60% reduction. Further treating the cold rolled steel strip in a Continuously Annealing Line (CAL).

The annealing cycle in the CAL includes heating to a temperature of 800-890° C., preferably 840-860° C., soaking for 80-180 s, preferably 100-140 s, slow gas jet cooling at a rate of 5-15° C./s to a temperature of 700-750° C., rapid gas cooling at a rate of 20 −60° C./s, preferably 30-50° C./s to an overaging temperature of 405-460° C., holding for 150 to 1000 s, before cooling to room temperature. The overaging temperature may be upward limited to 450, 440, 430 or 420° C. The lower limit may be 405, 406, 407, 408, 409, or 410° C. A preferred range for the overaging temperature is 405-420° C.

EXAMPLES

Steels I1-I3, and reference steels R1-R3 were produced by conventional metallurgy by converter melting and secondary metallurgy. The compositions are shown in table 1, further elements were present only as impurities, and below the lowest levels specified in the present description.

Table 1 disclose the composition of the examined steel sheets.

TABLE 1

Composition of examined steel sheets.

| Example | C | Si | Mn | Cr | Al |
|---|---|---|---|---|---|
| I1 | 0.114 | 0.95 | 2.76 | 0.181 | 0.047 |
| I2 | 0.105 | 0.83 | 2.65 | 0.194 | 0.049 |
| I3 | 0.105 | 0.82 | 2.65 | 0.198 | 0.042 |
| R1 | 0.106 | 0.84 | 2.67 | 0.197 | 0.048 |
| R2 | 0.118 | 0.94 | 2.77 | 0.17 | 0.051 |
| R3 | 0.112 | 0.93 | 2.7 | 0.169 | 0.046 |

Slabs of the steel alloys were produced in a continuous caster. The slabs were reheated and subjected to hot rolling to a thickness shown in table 2. The hot rolling finishing temperature was about 900° C. and the coiling temperature about 550° C. The hot rolled strips were pickled and batch annealed at about 620-625° C. for a time of 10 hours in order to reduce the tensile strength of the hot rolled strip and thereby reducing the cold rolling forces. The strips were thereafter cold rolled in a five stand cold rolling mill to a final thickness of about 1.4 mm (I1, I3, R1, R2) or 1 mm (I2, R3) and finally subjected to continuous annealing.

Table 2 discloses the hot and cold rolling parameters. The batch annealing was performed between the hot- and cold rolling steps for about 10 h.

TABLE 2

Hot and cold rolling parameters.

| Example | Hot rolled thickness (mm) | Batch annealing temperature (° C.) | Cold rolling thickness (mm) | Cold rolling reduction (%) |
|---|---|---|---|---|
| I1 | 2.80 | 624 | 1.4 | 50 |
| I2 | 2.8 | 620 | 1 | 65 |
| I3 | 3.2 | 626 | 1.4 | 56 |
| R1 | 2.8 | 625 | 1.4 | 49 |
| R2 | 2.8 | 624 | 1.4 | 49 |
| R3 | 2.7 | 624 | 1 | 64 |

The annealing cycle consisted of heating to a temperature of about 850° C., soaking for about 120 s, slow gas jet cooling at a rate of about 10° C./s to a temperature of about 720° C., rapid gas cooling at a rate of about 40° C./s to an overaging temperature of above 405° C. for the inventive examples, and about 390-395° C. for the non-inventive examples, isothermal holding at the overaging temperature and final cooling to ambient temperature.

The details of the treatment in the CAL are given in Table 3. The different overaging temperatures affects the yield strength and bending properties of the steel as can be seen in table 4.

TABLE 3

Parameters of the treatment in the CAL.

| Example | Annealing temp. (° C.) | Slow Jet Cooling temp. (° C.) | Rapid Jet Cooling temp. (° C.) |
|---|---|---|---|
| I1 | 853 | 720 | 407 |
| I2 | 854 | 720 | 411 |
| I3 | 854 | 720 | 408 |
| R1 | 846 | 720 | 394 |
| R2 | 847 | 720 | 391 |
| R3 | 850 | 720 | 390 |

The material produced according to the invention was found to have excellent mechanical properties as shown in Table 4.

All steels have a tensile strength in the range of 980-1180 MPa. Total elongation was more than 11% for all steels.

The inventive steels I1-I3 has a yield strength below 750 MPa. In particular, it may be noted that all inventive examples disclose a bendability (Ri/t) less than 2.0 in combination with a yield ratio of less than 0.72. The highest Ri/t was 1.5. and the highest yield ratio was 0.64. The reference steels R1-R3 do not meet the requirements of yield strength, and yield ratio in combination with bendability.

FIG. 1 is a diagram where the bendability Ri/t is plotted against the yield ratio. The examples I1-I3 are within the claimed border of claim 1, marked as "area of protection", whereas the reference R1-R3 are outside of it.

TABLE 4

Mechanical properties.

| Example | Yield Strength $R_{p0.2}$ (MPa) | Tensile Strength $R_m$ (MPa) | Yield ratio ($R_{p0.2}/R_m$) | Total Elongation, $A_{50}$ (%) | Ri | Ri/t |
|---|---|---|---|---|---|---|
| I1 | 646 | 1070 | 0.60 | 12.6 | 2.0 | 1.4 |
| I2 | 642 | 1020 | 0.63 | 14.0 | 1.5 | 1.5 |
| I3 | 643 | 1004 | 0.64 | 14.1 | 2 | 1.4 |
| R1 | 863 | 1038 | 0.83 | 14.2 | 2.5 | 2.1 |
| R2 | 811 | 1084 | 0.75 | 13.5 | 3.0 | 1.8 |
| R3 | 953 | 1092 | 0.87 | 11.2 | 3.0 | 3.1 |

The $R_m$ and $R_{p0.2}$ values are derived according to the European norm EN 10002 Part 1, wherein the samples were taken in the longitudinal direction of the strip. The elongation ($A_{50}$) is derived in accordance with the Japanese Industrial Standard JIS Z 2241: 2011 for samples taken in the transversal direction of the strip.

Ri/t was determined in V bend test in accordance with JIS Z2248. Samples (35×100 mm) of the produced strips were subjected to the V bend test to find out the limiting bending radius (Ri). The samples were examined both by eye and under optical microscope with 25 times magnification in order to investigate the occurrence of cracks. Ri/t was determined by dividing the limiting bending radius (Ri) with the thickness of the cold rolled strip (t). Ri is the largest radius in which the material shows no cracks after three bending tests.

The material of the present invention can be widely applied to high strength structural parts in automobiles. The high strength steel sheets are particularly well suited for the production of parts having high demands global formability and bendability. It is particularly suitable for a B-pillar hinge, roof rail or door panel of an automobile.

The invention claimed is:

1. A high strength cold rolled steel sheet having:

a) a composition consisting of the following elements (in wt. %):

| | |
|---|---|
| C | 0.08-0.14 |
| Mn | 2.5-3.0 |
| Si | 0.7-1.1 |
| Cr | 0.05-0.4 |
| Optionally | |
| Al | ≤0.2 |
| Nb | ≤0.1 |
| Mo | ≤0.1 |
| V | ≤0.1 |
| Ti | ≤0.1 |
| Ca | ≤0.05 |
| Cu | ≤0.1 |
| Ni | ≤0.2 |
| B | ≤0.005 |

balance Fe apart from impurities, b) a multiphase microstructure comprising of (in vol. %):

| | |
|---|---|
| retained austenite | 2-20 |
| martensite | ≤15 |
| bainitic ferrite and tempered martensite | 50-90 |
| polygonal ferrite | ≤10, |

c)

| | |
|---|---|
| a tensile strength ($R_m$) | 980-1180 MPa |
| a yield strength ($R_{p0.2}$) | 580-750 MPa |
| a yield ratio ($R_{p0.2}/R_m$) | ≤0.72, and |

d) a bendability according to a 90° V Bend test value Ri/t≤2.0 for a sample having the size of 35×100 mm, wherein Ri is the bending radius in mm and t is the thickness in mm of the steel sheet.

2. A high strength cold rolled steel sheet according to claim 1, wherein the microstructure fulfils at least one of the following requitements (in vol. %):

| | |
|---|---|
| retained austenite | 5-15 |
| martensite | 5-10 |
| bainitic ferrite and tempered martensite | 70-90 |
| polygonal ferrite | ≤5. |

3. A high strength cold rolled steel sheet according to claim 1, wherein the composition fulfils the following (in wt. %):

| | |
|---|---|
| C | 0.09-0.12 |
| Mn | 2.5-2.9 |
| Si | 0.7-1.0 |
| Cr | 0.1-0.3 |
| Al | 0.005-0.1 |
| optionally | |
| Nb | ≤0.1 |
| Mo | ≤0.1 |
| V | ≤0.1 |
| Ti | ≤0.1 |
| Ca | ≤0.05 |
| Cu | ≤0.1 |
| Ni | ≤0.2 |
| B | ≤0.005 |

balance Fe apart from impurities.

4. A high strength cold rolled steel sheet according to claim 1, wherein the mechanical properties fulfilling at least one of the following requirements:

| | |
|---|---|
| tensile strength ($R_m$) | 1000-1100 MPa |
| yield strength ($R_{p0.2}$) | 580-700 MPa |
| total elongation ($A_{50}$) | ≥11% |
| yield ratio ($R_{p0.2}/R_m$) | 0.50-0.70 |
| bendability (Ri/t) | ≤1.7. |

5. A high strength cold rolled steel sheet according to claim 1, wherein the mechanical properties fulfilling the following requirements:

| | |
|---|---|
| tensile strength ($R_m$) | 1000-1100 MPa |
| yield strength ($R_{p0.2}$) | 580-700 MPa |
| total elongation ($A_{50}$) | ≥11% |
| yield ratio ($R_{p0.2}/R_m$) | 0.50-0.70 |
| bendability (Ri/t) | ≤1.5. |

6. A high strength cold rolled steel sheet according to claim 1, wherein the thickness of the cold rolled sheet is 0.9-1.6 mm.

7. A high strength cold rolled steel sheet according to claim 1, wherein at least one of the elements selected from the group of Nb, Mo, V, Ti and Ca is present as an impurity.

8. A method of manufacturing of a cold rolled steel strip or sheet according to claim 1, comprising the following steps:

a) providing a steel slab having a composition according to anyone of the preceding claims b) hot rolling the slab in the austenitic range to a hot rolled strip;

c) coiling the hot rolled strip at a coiling temperature in the range of 500-650° C.;

d) optionally performing scale removal process on the coiled steel strip;

e) batch annealing at a temperature in the range of 500-650° C. for a duration of 5-30 h;

f) cold rolling the annealed steel strip with a reduction rate between 35 and 90%;

g) heating the strip in a continuous annealing line to a temperature between 800° C. and 890° C. and soaking for 80-180 s;

h) slowly cooling the strip at a rate of 5-15° C./s to a temperature of 700-750° C., followed by rapidly cooling the strip at a rate of 20-60° C./s to an overaging temperature of 405-460° C., and holding for 150 to 1000 s; and i) cooling to room temperature.

9. An automotive structural part comprising the high strength cold rolled steel material according to claim 1.

10. The automotive structural part according to claim 9, wherein the structural part is a B-pillar hinge, roof rail, or a door panel of an automobile.

11. A high strength cold rolled steel sheet according to claim 1, wherein the microstructure fulfils all of the following requitements (in vol. %):

| | |
|---|---|
| retained austenite | 5-15 |
| martensite | 5-10 |
| bainitic ferrite and tempered martensite | 70-90 |
| polygonal ferrite | ≤5. |

12. A high strength cold rolled steel sheet according to claim 1, wherein all of the elements selected from the group of Nb, Mo, V, Ti and Ca are present as impurities.

* * * * *